United States Patent [19]

Barrett

[11] Patent Number: 4,702,327

[45] **Date of Patent: * Oct. 27, 1987**

[54] CORE SAMPLE TAKING BULLET CONSTRUCTION

[75] Inventor: Bracell P. Barrett, Bellaire, Tex.

[73] Assignee: Barrett Machine Works, Houston, Tex.

[ * ] Notice: The portion of the term of this patent subsequent to Feb. 11, 2003 has been disclaimed.

[21] Appl. No.: 645,696

[22] Filed: Aug. 30, 1984

Related U.S. Application Data

[63] Continuation-in-part of Ser. No. 410,524, Aug. 23, 1982, abandoned.

[51] Int. Cl.[4] ..... E21B 49/02

[52] U.S. Cl. ..... 175/4; 175/58; 175/405

[58] Field of Search ..... 175/3, 4, 403, 405, 175/58, 4.57, 20, 248, 249

[56] References Cited

U.S. PATENT DOCUMENTS

| | | | |
|---|---|---|---|
| 2,334,428 | 11/1943 | Miller | 175/4 |
| 3,072,202 | 1/1963 | Brieger | 175/4 |
| 3,220,490 | 11/1965 | Urbanosky et al. | 175/4 |
| 3,329,217 | 7/1967 | Urbanosky | 175/4 |
| 4,280,568 | 7/1981 | McPhee et al. | 175/4 |

FOREIGN PATENT DOCUMENTS

| | | | |
|---|---|---|---|
| 1222714 | 8/1966 | Fed. Rep. of Germany | 175/58 |

OTHER PUBLICATIONS

J. Toney and J. L. Speights, "Coring", World Oil, Aug. 1, 1985, p. 31.

Schlumberger, "Sidewall Sampling", Ad, 1939, p. 2.

*Primary Examiner*—James A. Leppink

*Assistant Examiner*—Matthew Smith

*Attorney, Agent, or Firm*—Gunn, Lee & Jackson

[57] ABSTRACT

In the preferred and illustrated embodiment of the core sample bullet construction, a multi-piece construction is set forth. There is a forward, or removable, nose portion. It nests with and connects to a carrier portion. The two portions together define an elongate central bore formed in multiple portions, and the bore is open through the rear of the carrier. At the rear, a separate and removable bottom cap is plugged into the carrier portion and the two are joined together at the time of assembly, before firing. A release ring is included on the outer face of the nose portion and protects the shoulder of the carrier portion, engaging the formation upon entry, and is sacrifically abandoned; the ring is a mechanism for releasing the nose portion whereby retraction is easily obtained; the release ring includes drilling mud and debris relieving notches formed in the inside diameter.

25 Claims, 4 Drawing Figures

FIG. 1
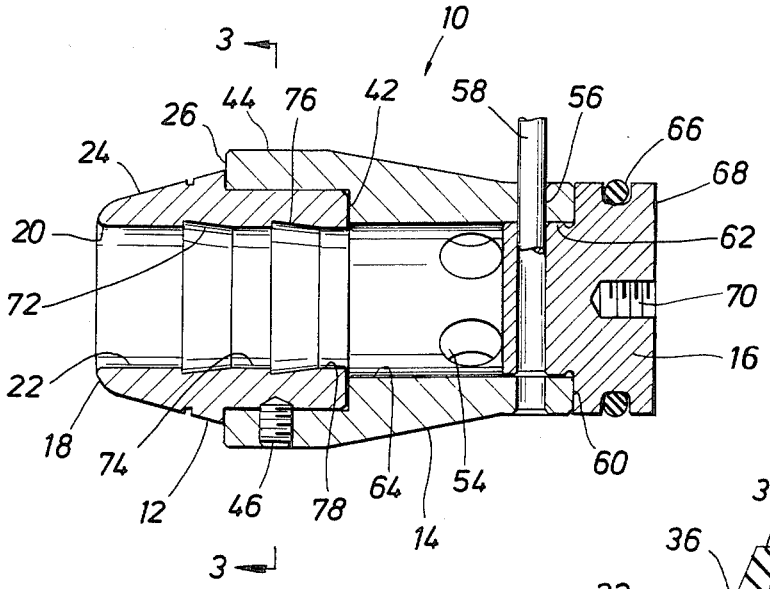
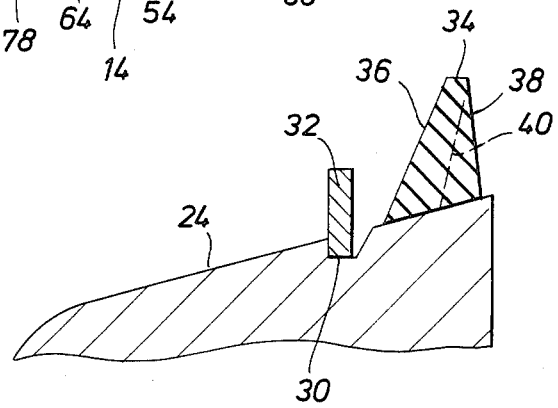
FIG. 2
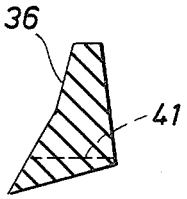
FIG. 4
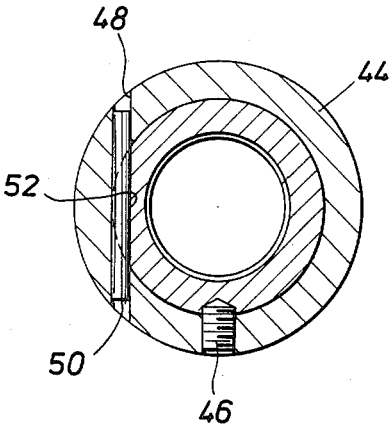
FIG. 3

CORE SAMPLE TAKING BULLET CONSTRUCTION

This application is a continuation-in-part of Ser. No. 410,524 filed Aug. 23, 1982, now abandoned.

BACKGROUND OF THE DISCLOSURE

This application is a continuation in part of the disclosure filed on Aug. 23, 1982, by the present inventor, which disclosure bears Ser. No. 410,524. As set forth in that disclosure and in particular as found at FIG. 8 thereof, a multi-piece construction bullet is described. This disclosure sets forth a multi-piece construction bullet having certain improvements and advances which are to be noted hereinbelow. The bullet construction of this disclosure should be particularly compared with that found in the patent of Urbanosky. U.S. Pat. No. 3,329,217 sets forth a straight sided bullet which disclosure primarily focuses on a slidable inner sleeve for gathering a particulate formation such as an unconsolidated sand. Urbanosky also shows in U.S. Pat. No. 3,220,493 a straight sided cylindrical bullet construction. This bullet incorporates a snap ring 26 which supports a release ring 25 on a forward shoulder. The ring is greater in diameter than the diameter of the bullet body. Austrian Pat. No. 204,981 shows a single piece construction bullet body having no release ring. It is of single piece construction. Austrian Pat. No. 268,170 discloses a bullet body of straight cylindrical sidewall construction.

These references do not disclose a formation sampling bullet which is constructed with telescoped components incorporating a relatively small sacrificial release ring means. In this construction, the release ring is secured next to an encircling groove on the outer face at the nose portion. When the bullet enters a formation to take a sample, the tapered outer face at the nose portion is jammed into the formation by the energy pushing the bullet, and the bullet is able to penetrate to a suitable depth. During penetration, the bullet body momentum forces the sloping or tapered outer face against the formation whereupon the release ring means serves as a brake to limit unnecessary bullet penetration. The release ring slides and possibly distorts during sliding movement. The outside ring diameter is intended to free the bullet for retrievability. That is, the sacrificial release ring is interposed between the bullet body and the formation to thereby lessen the grip of the formation. The notches in the inside diameter of the release ring are intended to vent mud suction. The bullet body is retrieved by pulling the bullet body with a retrieval cable or the like. This retrieval cable breaks the bullet body free and enables the user to retrieve the bullet body. The release ring is normally left in the formation, and the body can thereafter be used again and again.

The multi-piece construction bullet of this disclosure particularly enables substitution of nose portions. They can be changed dependent upon the nature of the formation encountered. Such changes might incorporate a longer or shorter nose portion; also, the radius of curvature at the nose portion can be changed. The angle of taper of the nose portion can likewise be varied. The dimensions of the internal longitudinal bore can also be changed. It is relatively less expensive to change only the nose portion as opposed to discarding the entire bullet body. The nose portion, with sample intact, can be separated from the carrier to submit the uncontaminated, unbroken sample intact for laboratory testing.

With the foregoing in view, the present disclosure presents a multi-piece construction sample collecting bullet body formed of three pieces in the preferred embodiment. There is a first or forward portion, which is known as the nose portion. It joins to a carrier portion and receives a bottom cap therein. They are secured together by connection at internal mating shoulder surfaces, and are fastened together as an assembly enabling a sample to be received in the longitudinal bore. Because of the exterior-interior angle relationships, the sample can be retrieved quite readily upon retrieval of the bullet. The bullet incorporates a sacrificial release ring on the outer face of the nose portion. The release ring is constructed with relieving flow paths for vents to enable drilling mud and debris to slide past the release ring.

This application is a continuation-in-part of application Ser. No. 410,524 filed Aug. 23, 1982 by the same inventor.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a sectional view longitudinally of the bullet body of this disclosure setting forth details of construction and including multiple components which enable the bullet to be assembled;

FIG. 2 is an enlarged detailed view of a release ring and supportive snap ring received in a groove around the nose portion of the bullet body;

FIG. 3 is a sectional view along the line 3—3 showing a set screw and fastening end for joining the components together into the assembled bullet assembly; and FIG. 4 is a sectional view of an alternate ring for the bullet.

DETAILED DESCRIPTION OF THE PREFERRED EMBODIMENT

Attention is first directed to FIG. 1 of the drawings where the numeral 10 identifies the bullet of this disclosure. It is formed of three major components which will be first identified and details of these components will then be set forth. The numeral 12 identifies a nose portion which is received and nested against a carrier portion 14. The nose portion 12 is fitted or telescoped into the carrier portion 14, and a bottom cap 16 is placed at the back end of a longitudinal bore through the carrier to close the bullet body.

The components fit together in the manner shown in FIG. 1, and form a sample collecting bullet 10 as will be described. In FIG. 1, the numeral 18 identifies the forward edge of the nose portion. The surface at 18 is somewhat rounded along a specified radius of curvature for penetration strength and to prevent breaking. There is a central opening 20 on the interior of the radius of curvature at 18, and the sample is received into a longitudinal bore having a first portion 22. The bore 22 is a right angle cylindrical construction defining an inside face within the nose portion 12. Thus, a sample is received, somewhat in the fashion of an extruded plug of material of the formation which is penetrated by the bullet. Cutting occurs at the cutting edge 18; while it is not quite an edge in the sense of having a knifelike cutting edge, it is a cutting surface or edge in the sense that it is made of rugged metal with suitable heat treating applied to thereby defined a mechanism which cuts a circular plug of material received into the first bore portion 22. This bore portion is concentric of the nose portion 12. The bore 22 terminates at an inside radius as described hereafter.

The forward bore portion 22 is within a wall of increasing thickness. The wall has an outer face 24. The outer face 24 tapers away from the longitudinal bore portion 22. The angle defining the outer face is typically in the range of about 8° to about 20°. For hard rock, the preferred angle is about 20°. For softer materials, an angle as narrow as about 8° will suffice. The outer face 24 smoothly flows or fairs into the curvature at 18 and hence defines the leading edge or cutting edge which cuts the circular plug. The outer face 24 thus extends backwardly and along the nose portion 12 until it terminates at a protruding shoulder 26. The shoulder 26 extends radially outwardly and is protected by the release ring (to be described) when it is fired into a formation. The shoulder 26 is the leading or facing edge of the carrier 14 as will be described. The cutting edge 18 has a radius of curvature of about 0.15 to about 0.24 inches, the preferred radius being 0.21 inches. The end of the bore 22 is cut to a radius of to about 0.03 to 0.09 inches. This removes any sharp edges.

The outer face 24 is shown enlarged at FIG. 2. A circular groove 30 is cut around the nose portion 12. The groove 30 is sized to receive a relatively thin snap ring 32. The snap ring is incorporated to fix in position a release ring 34. The snap ring is a sacrificial ring which is placed in the groove 30. The snap ring 32 is ultimately destroyed during use and must be replaced after each operation. The snap ring is, in relative size, not very tall and hence does not extend very far above the encircling groove 30. Rather, it is a convenience for fixing in location the release ring 34. This convenient attaching mechanism or means secures the release ring 34 to the rear in a captured location. The release ring 34 cannot slide to the left as shown in FIG. 2 because the snap ring prevents movement to the left. The release ring 34 is captured in the space between the snap ring 32 and the shoulder 26 behind the nose 24. Regarding the ring 32, it is ductile and able to permanently deform, and enables the release ring 34 to slide past the groove 30 on bullet retrieval.

The release ring has multiple faces. It encounters the earth's formation at a forward sloping face 36. There is a back face 38 which slants at about 5° to 10° relative a plane perpendicular to the axis of the bore through the body; the face 38 intercepts the face 36. The face 36 is set at an angle, typically in the range of about 20° to 40° while the back face angle is about 5° to 10°.

It will be noted that the face 38 on the back side of the release ring is approximately parallel to the shoulder 26. The formation drives the ring 34 into contact with the shoulder 26 on closure. This movement momentarily pressurizes in a pinching movement between the two faces, drilling mud or debris from the formation penetrated by the bullet body. There is instantaneous flow of drilling mud and debris behind the face 38. To provide relief for such pressurized material, relief notches are formed at 40. The notch 40 is typically cut by a rotating cutting tool and hence is a curved surface notched into the backface 38. The notch is thus defined at the dotted line 40 shown in FIG. 2, this line having an approximate angle of about 20° relative to the face 38. The number and spacing of the notches can be varied, but three or four such notches are believed to be sufficient for most sized bullets. Relatively even spacing around the periphery is normally sufficient. The notches are preferably located in the release ring; while they might be cut in the bullet body, this is more expensive in manufacturing and tends to weaken the bullet body.

In FIG. 4, the ring 34 is shown with notches 41. This embodiment is notched in a fashion opening the notches at the front face. The notches are again arcuate, being cut by a rotating tool. That is, the notches are cut by a rotating tool and are segments of a circle. The notches 41 are again evenly spaced, three or four being sufficient to enable operation. The notches emerge at the back face, slightly cutting the back face.

As will be understood in operation, the ring 32 is preferably made of spring steel material and is relatively thin. It is destroyed in use and operation. The ring 34 is preferably made of a material to withstand impact shock without shattering. Moreover, the ring 34 is used in a sacrificial fashion. When the bullet is fired into a formation, the formation material is engaged during penetration by the front face 36 and the release ring is forced toward the shoulder 26. As the sloping face 36 of the release ring 34 is forced backward toward the shoulder, the movement initiates hoop elongation accompanied by rotation of the release ring. As the bullet slows, the elongated and rotated release ring tends to snap back to its original shape, creating a spring force to urge the shoulder 26 rearward, thus initiating bullet release. Normally, the ring encounters the formation and catches a significant portion of the resistence of the formation. Thus, after the bullet body has embedded in the formation when the sample is obtained, the embedment often swallows and engulfs the release ring; on retrieval, the release ring is left embedded in the formation because the ring is then free to slide over the smaller nose portion. The nose can be retrieved along with the bullet body and the ring 34 is left to enhance and ease retrieval of the bullet body. The thin snap ring 32 is easily swept aside by the nose penetration into the formation, freeing the ring 34 for easy release of the bullet.

The ring 34 is pushed back on the sloping bullet, creating a hoop stress acting on the ring 34. That is, it is stretched during bullet entry into the formation. Stretching places tensile stress in the bullet which creates a restoring force for the bullet. Simultaneously, the ring 34 is loaded on the front face 36 by formation resistance to bullet penetration. This creates a force which tends to rotate or twist the ring 34. This loading on the front face tends to rotate the ring 34; as viewed in side view in FIG. 2, the top of the face 36 tends to rotate clockwise while pivoting around the contact of the back face 38 with the bullet body. Assume that this twisting involves rotation through about 5°; in this event, a restoring force is created and adds to the restoration force of hoop stress relaxation. Both forces assist in bullet retrieval from the formation. An important additional force making bullet retrieval easier arises from drilling mud hydraulic flow. The bullet is fired into the mud cake, assuring that mud surrounds the release ring 34. Pressure is instantaneously built up against the shoulder 26. The peak pressure creates a force on the shoulder 26 tending to expel the bullet from the mud, and the bullet appears to be more easily retrieved as a result of these forces.

The carrier is constructed with an internal shoulder 42. The shoulder abuts the back end of the nose portion 12. The two portions nest together at that shoulder. The shoulders 26 and 42 define the overlap between the two members; there is an enlarged skirt 44 around the smaller nose portion which secures the two in coaxial alignment. The shoulders 26 and 42 cooperate with facing shoulders on the nose portion 12, and a set screw 46 is received in a suitable threaded opening to fasten through the surrounding skirt or wall 44. The set screw is also shown in FIG. 3 of the drawings. There it will be noted that the set screw is headless so that it can be recessed where it does not snag or hang on the formation. The fastener provided by the set screw is aligned by forming a dimple in the nose portion 12 to match the point of the set screw.

As an alternate embodiment of fastener, the wall or skirt 44 is drilled with a hole 48, and a fastening pin 50 is received in the hole. A flat 52 is machined on the outside cylindrical face of the nose portion from the back end. The pin 50 is frictionally held in the hole. The flat 52 is sized so that the pin 50 secures the two members against relative rotation by creating a cam and cam-lock for the pin. That is, at the time of assembly, the pin 50 is forced into the hole 48 and mates against the flat 52 to fasten the two members together. This secures the two members together against relative rotation.

The carrier has a number of relief openings at 54. It is also drilled with a pair of aligned openings at 56 to receive a fastening pin 58. At the rear, a shoulder 60 defines a surface for the bottom cap 16. The bottom cap has a circular periphery at 62 which nests in the longitudinal bore 64. The bore portion 64 will be discussed hereinafter. The bottom cap is a solid closure member. It has an external seal receiving groove at 66. The groove 66 is immediately adjacent to the back end at 68, this being in the form of a transverse face. A retrieval cable is connected to the bullet in a suitable fashion at a threaded opening 70 in the cap 16. The bullet bottom 16 is equipped with the shoulder 60 conforming to the facing and mating shoulder. The two members contact at the broad surface area 60 to enable firing power to drive both parts as a unit into the formation. The two parts move as a unit without damage at the contacted shoulder area 60. The neck of the bullet bottom 16 above the shoulder 60 is machined with a radius to eliminate stress concentration at what would otherwise be a sharp corner. It has been discovered that bullet bottoms on firing impact, otherwise tend to concentrate stress and fracture near the neck. Also, the bottom 16 is scaled by the seal ring in the rounded groove 66.

The bottom of this structure transfers firing impact to the bullet body without splitting the side wall of the bullet body. The smooth shoulder 60 nests and seats to enable the components to work together without splitting even when used repetitively.

Going now to the longitudinal bore through the device, the bore is defined by multiple portions. First of all, there is the right cylindrical first bore portion at 22. It has a specified diameter. There is a last or rear bore portion at 64 and it tapers from shoulder 42 inwardly. The rear bore 64 is larger in diameter so that the sample can be received in it to permit expansion and packing. There is an intermediate bore portion between the portions 22 and 64. The intermediate bore portion may be defined by several segments which need to be described. These bore portions are machined on the interior of the nose portion 12.

First of all, the numeral 72 identifies a tapered bore portion. It tapers and terminates at a cylindrical bore portion 74 that is larger than the bore portion 22. Another tapered bore portion 76 is similar to the tapered bore portion 72. The bore portions 72 and 76 are similar in construction, tapering from a larger to a smaller diameter as shown in FIG. 1 on viewing the bullet from left to right. The bore portion 74 is similar to another segmented bore portion 78. These two portions separate or isolate the tapered portions. The four bore portions 72, 74, 76 and 78, which are in the intermediate area, define a set of serrations. When the plug shaped sample is forced into the longitudinal bore, moving from left to right in FIG. 1, the tapered portions enable serrations to grip and hold the sample so that it does not slide out back to the left. That is, the sample is forced into the bullet by the energy of the bullet as it impacts the formation. Moreover, the sample, having the form of a cylindrical plug, is gripped tightly when it first is forced through the cylindrical bore 22. As the sample penetrates into the bullet body, it is held more loosely in the central portions of the bore. Because of the snug fit at the forward end 22 of the longitudinal bore, the plug is more securely held, thereby enabling the sample to be broken away from the earth's formation, and the risk of dropping the sample plug out of the bullet during retrieval of the bullet from the well is markedly reduced. Accordingly, securing the sample in the central portions of the longitudinal bore having a larger diameter enables one to assure more secure retrieval. The serrations cooperate with the wall of the structure to reduce shock to the core and to the surrounding wall; in addition, the serrations assist in strengthening the wall.

There is a slight increase in size between the forward longitudinal bore 22 and the steps 74 and 78. Typically, they are larger by about 0.01 to about 0.015 inches. This enables the sample to be retrieved within the central bore portions, and therefore provides greater assurance of sample recovery. The bore from 22 may also be smooth, without steps, and tapered out to securely hold the sample.

As will be noted, the sample must be retrieved out through the back of the nose portion on removal of the cap 16. The fastening pin 58 joins the bottom cap 16. On disengaging the pin 58, the sample can be quickly retrieved by pulling the bottom cap from the bore portion at the rear, and the sample is easily pushed to the rear and out the rear opening. Alternately, by removing the set screw 46, the nose portion 12 and the carrier portion 14 may be separated.

As will be observed, the surrounding skirt or wall 44 defines the maximum diameter of the bullet. Typically, the bullet will enter until the shoulder 26 is significantly engaged by the formation. Should the shoulder 26 pass into the formation by some distance, the bullet body is cylindrical behind the shoulder 26, enabling easy retrieval. Moreover, should the formation tend to grip the bullet after penetration, the grip is released in more or less easy fashion by disengagement from the tapering outer face 24 sliding beneath the release ring.

As will be understood, this device is intended for multiple use. It can be used repeatedly. Should wear occur, the first point of wear is at the nose portion, and it typically can be replaced while the carrier can be used again and again. The carrier may wear at the face 26 or on the exposed wall just behind the shoulder 26. In either case, such wear and tear do not detract from the repeated use of the carrier. Of the three members, the carrier is relatively more expensive to machine and manufacture, and hence relative long life for the carrier cuts down on the cost of the sample collection procedure. The bottom cap is also a relatively durable item and is not exposed to the same wear and tear as the nose portion. The nose portion can be manufactured with a variety of shapes and mass to thereby define different types and qualities for retrieval of samples from any formation. The manufactured nose portion can be changed on site to accommodate differences in formations and to provide greater flexibility in service to customers.

While the foregoing is directed to the preferred embodiment, the scope is determined by the claims which follow.

What is claimed is:

1. In a formation sampling bullet adapted to be fired at high speed by an explosive charge from a support apparatus into an earth formation adjacent to a well borehole to penetrate the formation with a nose portion to obtain and hold a formation sample core in a longitudinal bore extending rearwardly from said nose member portion of said bullet, the bullet comprising:

(a) an initial contact nose portion of a bullet forward of a longitudinal bore terminating at a circular opening of specified diameter at said nose portion, said nose portion defining a cutting means around said opening to cut a sample core entering into said bore;

(b) an encircling wall surrounding said longitudinal bore to define said bore which bore extends to the rear of said cutting means;

(c) an internal cylindrical surface defining said longitudinal bore, said bore having a forward bore portion of right cylindrical configuration serially connected with an intermediate storage bore portion and wherein said intermediate bore portion opens into a rear bore portion adapted to receive an insertable closure means therein;

(d) an outer face behind said cutting means for contacting the formation on entry of said nose portion into the formation and said outer face defining an enlarged taper portion behind said nose portion;

(e) said nose portion in longitudinal sectional view, being a rounded surface intersecting said outer face and said internal cylindrical surface;

(f) release ring means surrounding said outer face; and (g) retainer means for holding said release ring means initially on said outer face during entry of said bullet into the formation.

2. The apparatus of claim 1, further wherein:

(a) said release ring means includes a sloping cooperative internal face fitting around said outer face; and (b) fluid flow relief means cooperative with said release ring means to enable formation debris and drilling mud to flow from behind said release ring means.

3. The apparatus of claim 1 including holes formed in said wall near the rear bore portion and adapted to receive at a sheltered location a connective means extendable to a bullet firing gun.

4. The formation sampling bullet of claim 1 wherein said longitudinal bore has a centered longitudinal axis and wherein said intermediate bore portion is defined at an internal shoulder, said intermediate portion includes stepped portions.

5. The formation sampling bullet of claim 1 further including a radius of curvature defining said nose portion cutting means at said rounded surface.

6. The apparatus of claim 1 wherein said nose portion comprises a removable and separable first body portion, and a second body portion joins to said first body portion at an internal facing shoulder in said second body portion, and said first and second body portions collectively form said bullet body.

7. The apparatus of claim 6 wherein said first portion is separable to enable interchange with first portions having alternate nose length and alternate cutting means thereon.

8. The apparatus of claim 7 wherein said first and second portions are joined together by removable fastener means.

9. The apparatus of claim 8 wherein said fastener means includes a locking pin.

10. The apparatus of claim 8 wherein said fastener means includes a set screw.

11. The apparatus of claim 1 including internal serrations in said longitudinal bore.

12. The apparatus of claim 1 including an axially tapered internal surface in said longitudinal bore.

13. The apparatus of claim 1 including an encircling groove in said outer face for receiving a snap ring comprising said retainer means.

14. The apparatus of claim 2 including a back face on said release ring means, said face defining a curving plane symmetrically to said longitudinal bore and having a plurality of notches formed therein comprising said fluid flow relief means.

15. The apparatus of claim 14 wherein said release ring means is canted during bullet penetration to cock and spring back to assist bullet release from the formation.

16. The apparatus of claim 14 wherein said notches open to the cooperative face and are spaced around said release ring means to flow debris and drilling mud past said release ring means.

17. In a formation sampling bullet adapted to be fired at high speed by an explosive charge from a support apparatus into an earth formation adjacent to a well borehole to penetrate the formation with a nose portion to obtain and hold a formation sample core in a longitudinal bore extending rearwardly from said nose member portion of said bullet, the bullet comprising:

(a) an initial contact nose portion of a bullet forward of a longitudinal bore terminating at a circular opening of specified diameter at said nose portion, said nose portion defining a cutting means around said opening to cut a sample core entering into said bore;

(b) an encircling wall surrounding said longitudinal bore to define said bore which bore extends to the rear of said cutting means;

(c) an internal cylindrical surface defining said longitudinal bore, said bore having a forward bore portion of right cylindrical configuration serially connected with an intermediate storage bore portion connected to a rear bore portion adapted to receive an insertable closure means therein;

(d) an outer face to the rear of said cutting means for contacting the formation on entry of said nose portion into the formation, said outer face defining an enlarged taper portion rearwardly of said nose portion; and (e) wherein said cutting means has a curved surface (in longitudinal section through said cutting means) between diverging edges inscribing an angle between about 8° and about 20° and the curved surface has a radius of between about 0.15 and about 0.24 inches.

18. The apparatus of claim 17 wherein said cutting means angle is about 20° for cutting hard rock formations.

19. The apparatus of claim 17 wherein said cutting means radius is about 0.21 inches.

20. The apparatus of claim 17 wherein said cutting means inscribed angle is defined by two straight line segments rearwardly of the curved surface and coincident with said longitudinal bore and said outer face.

21. The apparatus of claim 17 wherein said closure means includes a bullet body cap having a shoulder surface encircling said cap to receive and seat against said bullet to close said rear bore portion, said cap having a neck extending partly into said rear bore portion from said shoulder surface, and wherein said neck is integrally made with said cap and said neck joins to said cap free of stress concentrating shapes.

22. The apparatus of claim 1 wherein said closure means includes a bullet body cap having a shoulder surface encircling said cap to receive and seat against said bullet to close said rear bore portion, said cap having a neck extending partly into said rear bore portion from said shoulder surface, and wherein said neck is integrally made with said cap and said neck joins to said cap free of stress concentrating shapes.

23. The apparatus of claim 21 wherein said cap includes a rounded groove integral at said neck and said cap.

24. The apparatus of claim 1 wherein said release ring has an exposed outer face for contact against the formation, and wherein said outer face is angularly inclined rearwardly and extends fully around said ring, said ring outer face having a generally concave indention extending fully about said ring.

25. In a formation sampling bullet adapted to be fired at high speed by an explosive charge from a support apparatus into an earth formation adjacent to a well borehole to penetrate the formation with a nose portion to obtain and hold a formation sample core in a longitudinal bore extending rearwardly from said nose member portion of said bullet, the bullet comprising:

(a) an initial contact nose portion of a bullet forward of a longitudinal bore terminating at a circular opening of specified diameter at said nose portion, said nose portion defining a cutting means around said opening to cut a sample core entering into said bore;

(b) an encircling wall surrounding said longitudinal bore to define said bore which bore extends to the rear of said cutting means;

(c) an internal cylindrical surface defining said longitudinal bore, said bore having a forward bore portion of right cylindrical configuration serially connected with an intermediate storage bore portion connected to a rear bore portion adapted to receive an insertable closure means therein;

(d) an outer face to the rear of said cutting means for contacting the formation on entry of said nose portion into the formation, said outer face defining an enlarged taper portion rearwardly of said nose portion; and (e) wherein said cutting means has a curved surface (in longitudinal section through said cutting means) between diverging edges inscribing an angle between about 8° and about 20° and the curved surface has a radius of curvature.

* * * * *